United States Patent [19]

Stoppazzini

[11] Patent Number: 4,697,439

[45] Date of Patent: Oct. 6, 1987

[54] DEVICE FOR THE DISENGAGEABLE LOCKING OF THE LAST ROWS OF KNITTED FABRIC IN THE NEEDLE WORKING AREA OF AN AUTOMATIC FLAT KNITTING MACHINE

[75] Inventor: Benito Stoppazzini, Sala Bolognese, Italy

[73] Assignee: E.M.M. Emiliana Macchine Maglieria S.r.l., Bologna, Italy

[21] Appl. No.: 895,731

[22] Filed: Aug. 12, 1986

[30] Foreign Application Priority Data

Sep. 18, 1985 [IT] Italy ..... 3551 A/85

[51] Int. Cl.[4] ..... D04B 15/88

[52] U.S. Cl. ..... 66/149 R; 66/115

[58] Field of Search ..... 66/64, 60 R, 147, 149 R, 66/90, 115

[56] References Cited

U.S. PATENT DOCUMENTS 3,153,922 10/1964 Bram ..... 66/64

4,441,338 4/1984 Betts et al. ..... 66/64

4,506,525 3/1985 Robinson et al. ..... 66/64

*Primary Examiner*—Ronald Feldbaum

*Attorney, Agent, or Firm*—Stevens, Davis, Miller & Mosher

[57] ABSTRACT

A device consists of equidistant rods, located below the needle bed of a machine, perpendicular to the traverse direction of movement of a carriage, with the upper ends bent downwards to form a corresponding number of latch sections, and directed towards the upper heads of the needle beds.

The rods are controlled by a cam on the carriage; raising of the rods causes the latch sections to be inserted between the stitches of the fabric in the last rows of the fabric portion situated below the working area of the sections: in this way the latch sections act as stops for the rows.

Downstream from the working area of the needles, there is a fabric presser plate which presses the row just formed in a downwards direction and according to a preset pressure.

6 Claims, 8 Drawing Figures

FIG.1
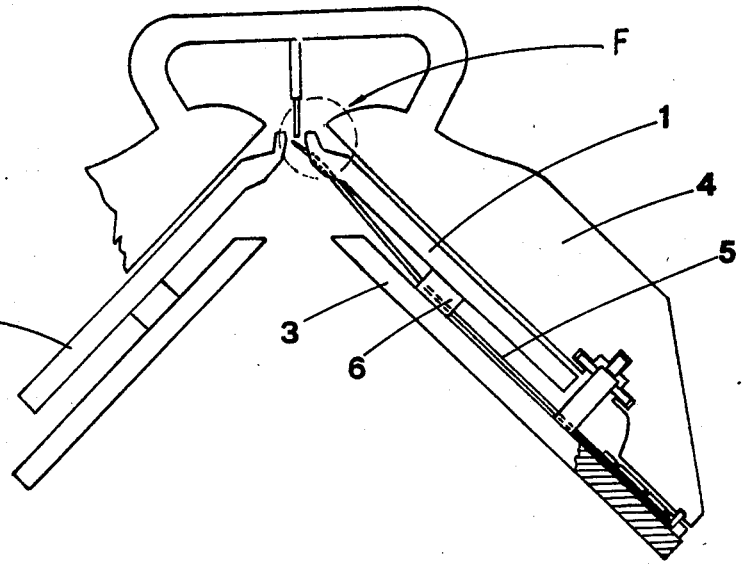
FIG.2
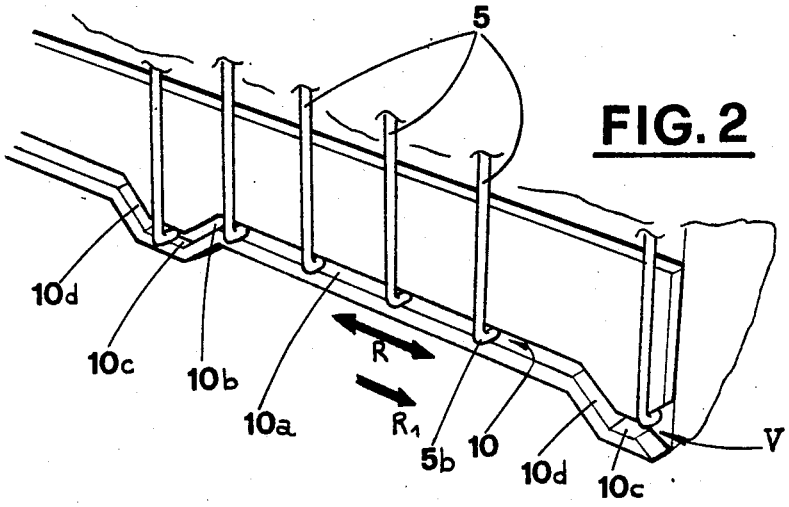
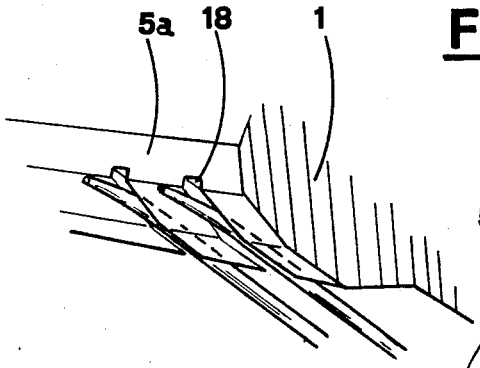
FIG.1a
FIG.3a
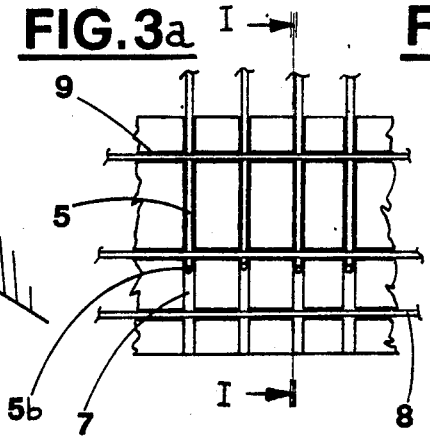
FIG.3b
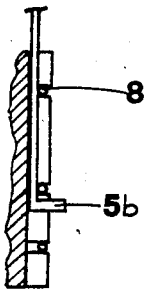

DEVICE FOR THE DISENGAGEABLE LOCKING OF THE LAST ROWS OF KNITTED FABRIC IN THE NEEDLE WORKING AREA OF AN AUTOMATIC FLAT KNITTING MACHINE

BACKGROUND OF THE INVENTION

The invention relates to a device for the disengageable locking of the last rows of knitted fabric in the needle working area of an automatic flat knitting machine.

DESCRIPTION OF THE PRIOR ART

It is well known that the needle beds of an automatic flat knitting machine consist of equidistant slots perpendicular to the carriage traversing direction.

Inserted in each slot there is, proceeding from top to bottom, first a needle (with a heel at the bottom) and a sinker which causes the aforementioned needle to come into operation if selected.

The sinker carries out selection by an initial upward movement (performed by selection means mounted on the carriage and acting on the sinker), this is followed by a second upward movement caused by interception of cams, operating in conjunction with the carriage, against corresponding heels made on each sinker; other fixed cams, located downstream from the cams previously mentioned have the task of returning the sinker to its rest position.

Raising the sinker beyond a present value causes a corresponding traversing of the needle, the heel of which is thus intercepted by related cams which have the function of causing the aforementioned needle to be operated and form the knit stitch or to transfer the stitch to and from another needle bed, or form the stitch known as a carry-over stitch.

Ideally, in the operation just described above, the last row of fabric should not be dragged upwards as the result of the upward movement of the needles nor should the row just knitted be pressed downwards as the needles return to the rest position.

In the patent application No. OS3336781 (Textima), there is an arm, attached to the machine carriage, positioned at the same height as the upper heads of the needle beds which is longitudinally parallel to the needle beds so as to operate in the area (understood in the dynamic sense) where the needles are raised, in other words, the said arm is "wedged" below the corresponding section of the needles protruding from the needle bed and is practically in contact with the last row of fabric.

A disc, supported by the carriage, and located downstream from the said arm and parallel to the traversing direction of the said carriage, has the task of pressing the last completed row downwards.

The solution just quoted above, where it is necessary to position the arm correctly so that it does not come into contact with the needles, is only suitable for use when the traversing direction of the carriage is fixed, i.e. it can only be used where the carriages work in a single direction.

For carriages which work in both directions it is necessary to have two arms located on opposite sides of the carriage; one of the said arms is disactivated (raised) for a particular carriage movement direction while the other arm is disactivated when the carriage traverses in the opposite direction.

SUMMARY OF THE INVENTION

This invention proposes a device which locks the last rows of fabric in the needle working area, and compresses the row of fabric just produced immediately downstream from this area without interfering with any of the needle operations.

This invention also proposes a device which can operate in both carriage working directions of an automatic flat knitting machine and at the same time not interfere in any way with the operation and or productivity of the machine.

The aforementioned results are obtained by means of a device which temporarily locks the last rows of knitted fabric in the needle working area of an automatic flat knitting machine; the said machine consists of at least one needle bed, complete with carriage, with equidistant slots perpendicular to the carriage traversing direction; inserted in each of these slots there is, proceeding from top to bottom, a needle and a sinker; the sinker, if it has been selected by means of the devices situated on the said carriage will raise a corresponding needle; the said carriage also has means to cause the raised needles to operate and to return to their rest position after operation; the said device is characterised by: a quantity of equidistant rods, located below the needle bed, perpendicular to the carriage traversing direction, axially guided and supported by the machine frame; the upper ends of these rods are bent towards the upper head of the needle bed in the area of the needle bed where the last rows of the fabric being made are present; on the said carriage there are means to control the rods and move them to two extreme positions; in the first position at the upper end of the rod, the portion of last rows of fabric under the working area of the needles are locked; in the second position the said rod ends are disengaged from the said portion of material; a minimum of two fabric presser plates, mounted on the said carriage, and located above the upper head of the needle bed and parallel to the same are situated on both sides of the needle working area; these plates move vertically and are spring mounted and exert pressure in a downward direction; the fabric presser plate is located downstream from the working area of the needles and has the task of compressing the last row of fabric just knitted according to a preset pressure.

BRIEF DESCRIPTION OF THE DRAWING

The characteristics of this invention that do not emerge from what has been stated above are emphasised hereinafter with specific reference to the attached tables of drawings, in which:

FIG. 1 shows a cross section of a flat knitting machine on which the device herein described has been mounted;

FIG. 1*a* shows the construction details of part F in FIG. 1;

FIG. 2 shows the selection cam for the stop rods, in perspective and on a larger scale than in FIG. 1;

FIG. 3*a* shows a front view of the lower part of the rod guide mechanism;

FIG. 3*b* shows a view of section I—I in FIG. 3*a*;

DESCRIPTION OF THE PREFERRED EMBODIMENT

Figure 4A:
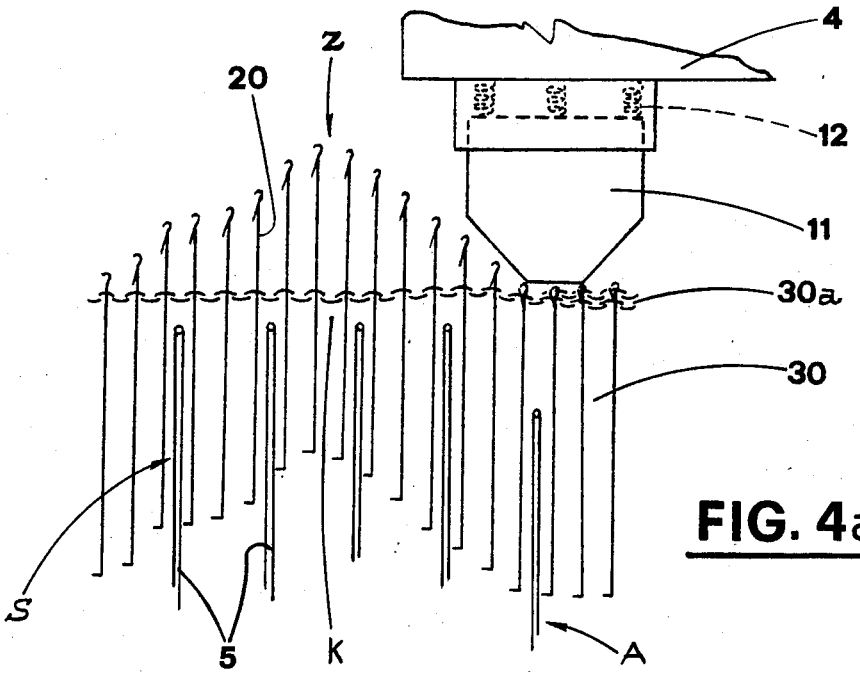
FIG. 4*a* and FIG. 4*b* schematically represent the functions performed by the device.

In the drawings, the numbers 1 and 2 show two needle beds of a flat knitting machine, supported in the usual manner by a frame 3; on the needle beds there is a carriage 4 which is shown only schematically here since it is well known.

It is well known that the needle beds have equidistant slots in each of which there is, proceeding from top to bottom, a needle 20 and a sinker (not shown here); the sinker has the function of raising a corresponding needle, by means for this purpose mounted on the carriage (not shown here) to its working position and then returning it to its rest position (according to well known technical principles).

Below the needle bed 1 there are a number of equidistant rods perpendicular to the carriage traversing direction R.

Each rod is centrally supported and at the same time axially guided by a block 6 fixed to the frame 3; the lower end of the rod is inserted in an groove 7 made in the frame and is prevented from coming out of the groove by wires 8 which are inserted in the transverse grooves 9 above and in contact with the bottom part of each rod.

The upper end of each rod is bent downwards; thus forming a latch section 5*a*; the bottom end of each rod has a heel 5*b*; below the latch section the rod is guided by an groove 18 made in the lower face of the needle bed 1 (FIG. 1*a*).

In the lower part of the carriage there is a cammed groove 10 ; when the carriage traverse 8, the heel 5*b* of each rod is inserted in this aforementioned groove.

The said cam consists of straight sections 10*a* parallel to the carriage traversing direction R which are then followed in turn by a straight descending section 10*b*, a lowered straight section 10*c* parallel to the section 10*a* (but of a considerably shorter length than this) and then finally a rising section 10*d*.

Figure 4B:
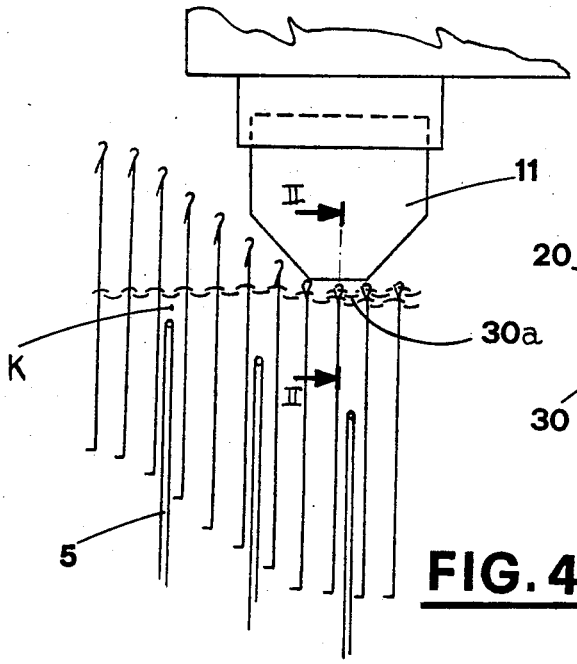

When the carriage 4 traverses (for example in direction R1), the heel 5*b* is caught in the "V" guide of the cammed groove 10 formed by the lowered section 10*c* and the rising section 10*d* (FIG. 2). With the heel 5*b* inserted in the straight section 10*a*, the rod is at the extreme of its raised position S (FIGS. 1, 4*a*, 4*b*); the heel is thus forced to run down the descending section 10*b* and the rod moves downwards to arrive at the extreme of its lowered position when the heel is in the straight section 10*c* FIGS. 4*a*, 4*b*); the successive rising section 10*d* of the groove 10 causes the rod to move upwards until it reaches the straight section 10*a* situated downstream (in relation to the direction R1) of the previous section 10*a*.

The carriage 4 has plates 11 located over the upper heads of the needle beds, the plates being parallel to and symetrical with the needle beds; the plates are attached to the carriage so that they move vertically: spring means 12 force the plates in a downward direction.

The total number of plates is greater by one unit than the total number of the aforementioned sinker selection units on the carriage (e.g. two plates, three plates, five plates for one, two, and four selection units respectively); two consecutive plate are positioned laterally on each side of the corresponding working area Z of the needles 20.

It should be noted that the vertical plane of symmetry of each plate coincides with plane of symmetry of the descending section 10*b* and the rising section 10*d* of the cam 10.

When the rods are outside the carriage, the rods are in the lowered position A: this is caused by the cam 10 ends formed by the lowered sections 10*c*.

The rods which have their heels inserted in the cam 10, will be in the raised position S if the heels are running along the straight section 10*a* of the cam or will be in the lowered position A if the heels are running along the straight lowered sections 10*c*.

The latch sections 5*a* of the raised rods are inserted into the stitches of the fabric 30 close to the last fabric rows (FIG. 4*a*) in order to act as stops for the said rows; the section of fabric involved here is the portion K to be found under the needle working area Z: in this way the raising of the needles does not cause the last fabric rows to be drawn upwards, this is an ideal situation when forming knitted stitches with needles.

It should be pointed out that the situation just described above is a result of rod stability; when a rod is under strain it is stopped from oscillating by the combined action of the block 6 (within which it runs) and the lower face of the needle bed 1 on which the groove 18 has been cut and within which the rod moves.

It is well known that the operation of the needles, downstream from the needle working area Z, forms the new row 30*a* of fabric 30.

Figure 4C:
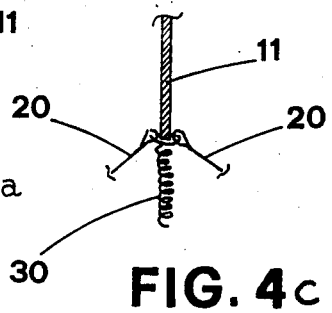
FIG. 4*c* shows a view of section II—II of FIG. 4*b*.

Immediately downstream from the area Z, the plate 11 presses the row just formed 30*a* in a downward direction (FIG. 4*c*); this compressing action is in no way prevented by the rods 5 since the rod 5 at that moment under the plate (as already described) is in the lowered position A (FIGS. 4*a*, 4*b*) which means that it has been disengaged (cast off) from the fabric rows.

The springs 12 cause the plate 11 to exercise a set downward pressure and at the same time allow it to move upwards in the presence of an obstacle.

The trapezoidal shape of the lower head of each plate has been designed with the aim of preventing interference from the needles downstream, those in the raised phase, and the needles upstream, those in the lowered phase.

Thus the device enables disengageable temporary locking of the last rows of fabric 30 positioned below the working area Z of the needles 20 and applies downward pressure on the row 30*a* which has just been formed.

The device, which operates in both carriage operating directions, is shaped so as not to impede needle traversing and is designed to work close to the last fabric rows; the latch sections 5*a* can act as stops for the last fabric row.

There can be any number of rods to hold the rows below the working area Z; the number of rods used depends on the type of fabric to be made.

In the example described here, the rods 5 are controlled sequentially by mechanical means; it is obvious though that the rods could also be driven by electromechanical means controlled in turn by a pre-set program.

It is understood that the description given herein is purely an unlimited example and does not in any way exclude any subsequent variations in construction details which, it is understood all fall within the framework of protection afforded to the invention as claimed hereinafter.

What is claimed is:

1. A device for the disengageable locking of the last rows of knitted fabric in the needle working area of an automatic flat knitting machine, said machine consisting of at least one needle bed with a carriage, the former featuring equidistant slots perpendicular to the carriage traversing direction in which there are inserted, from top to bottom, a needle and a sinker which has the task, if selected by corresponding selection means mounted on said carriage, of raising a corresponding needle; there are also means on the carriage to cause the operation of the raised needles, and means to return the needles to their rest position following upon their operation; said device including: a quantity of equidistant rods, located below the needle bed, perpendicular to the carriage traversing direction, supported by the machine frame and axially guided by guide means, the upper ends of which these rods are bent towards the upper head of the needle bed in the area of the needle bed where the last rows of the fabric being made are present; means located on said carriage to control the rods and move them to two extreme positions, the portion of last rows of fabric, under the working area of the needles, being locked by said upper end of said rods when these latter are in the first position, and said portion being disengaged from said upper end of said rod when these latter are in the second position; a minimum of two fabric presser plates, mounted on said carriage, and located above the upper head of the needle bed and parallel to the same and situated on both sides of the needle working area, moving vertically and subjected to spring acting in a downward direction, said fabric presser plate located downstream from the working area of the needles having the task of compressing the last row of fabric just knitted according to the established pressure.

2. A device according to claim 1, wherein said control means for said rods, comprise a heel, formed in the lower part of each rod, and a cammed groove attached to said carriage, so that when said carriage traverses said heel of each rod is inserted into said groove, this latter consisting of, in the following order: a lowered straight section which corresponds to the second rod position, a rising section, a straight section corresponding to the first rod position, and finally another straight lowered section which once again corresponds to the second rod position; said lowered sections being vertically centred with said fabric pressing plates.

3. A device according to claim 1, wherein the upper end of each rod is bent downwards to form a latch section.

4. A device according to claim 1, wherein said guide means for said rods comprise for each rod: a block fixed to the machine frame, the central part of each rod moving inside this block; a groove made in said frame in which the bottom end of the rod is inserted; and another groove made in the lower face of the needle bed in which that part of the rod immediately following on from the end of the rod itself is inserted.

5. A device according to claim 4, wherein said groove in which the bottom part of said rod is inserted, is traversed by at least one transverse groove, in which there is a wire inserted on top of said rod in order to prevent the rod itself coming out of said groove.

6. A device according to claim 1, wherein the bottom head of each said fabric pressing plate has a trapezoidal form.

* * * * *